US010029147B2

(12) United States Patent
O'Connor

(10) Patent No.: US 10,029,147 B2
(45) Date of Patent: Jul. 24, 2018

(54) PADDLE FOR WATER SPORTS

(71) Applicant: Alexander Ian Nugent O'Connor, Edinburgh (GB)

(72) Inventor: Alexander Ian Nugent O'Connor, Edinburgh (GB)

( * ) Notice: Subject to any disclaimer, the term of this patent is extended or adjusted under 35 U.S.C. 154(b) by 0 days.

(21) Appl. No.: 15/113,546

(22) PCT Filed: Jan. 23, 2015

(86) PCT No.: PCT/GB2015/050152
§ 371 (c)(1),
(2) Date: Jul. 22, 2016

(87) PCT Pub. No.: WO2015/110824
PCT Pub. Date: Jul. 30, 2015

(65) Prior Publication Data

US 2017/0007887 A1 Jan. 12, 2017

(30) Foreign Application Priority Data

Jan. 23, 2014 (GB) ..... 1401166.2

(51) Int. Cl.

| | |
|---|---|
| ***A63B 31/10*** | (2006.01) |
| ***B63H 16/04*** | (2006.01) |
| ***A63B 35/00*** | (2006.01) |
| ***A63B 31/12*** | (2006.01) |

(52) U.S. Cl.
CPC ..... *A63B 31/10* (2013.01); *A63B 31/12* (2013.01); *A63B 35/00* (2013.01); *B63H 16/04* (2013.01); *A63B 2208/0242* (2013.01); *A63B 2225/09* (2013.01)

(58) Field of Classification Search
CPC ..... A63B 31/12; A63B 31/10; A63B 35/00; A63B 31/08; B63H 16/04
USPC ..... 441/59
See application file for complete search history.

(56) References Cited

U.S. PATENT DOCUMENTS 1,708,331 A * 4/1929 Ryan ..... A63B 31/08 441/58
3,092,855 A * 6/1963 Smith ..... B63H 16/04 416/72
3,407,419 A * 10/1968 Drummond
4,521,011 A * 6/1985 Solloway ..... A63B 21/0084 441/59

(Continued)

FOREIGN PATENT DOCUMENTS

EP 1498159 A1 1/2005

OTHER PUBLICATIONS

International Search Report to corresponding PCT/GB2015/050152, dated Jun. 10, 2015, 2 pages.

(Continued)

*Primary Examiner* — Stephen P Avila
(74) *Attorney, Agent, or Firm* — Tarolli, Sundheim, Covell & Tummino LLP

(57) ABSTRACT

A paddle for water sports is provided that allows a user to more effectively propel themselves through the water. The paddle comprises a blade, a fastener for fastening the paddle to a user's forearm, a gripping portion mounted to the blade and a connector extending from the fastener to the paddle, wherein the connector is bendable to enable the blade to be moved between an operating position and a stowed position.

18 Claims, 16 Drawing Sheets

(56) References Cited

U.S. PATENT DOCUMENTS

| | | | | |
|---|---|---|---|---|
| 6,264,519 | B1 * | 7/2001 | Brown | A63B 35/06<br>440/101 |
| 6,398,603 | B1 * | 6/2002 | Brown | A63B 31/12<br>440/101 |

OTHER PUBLICATIONS

Australian Examination Report dated Dec. 6, 2017 for corresponding AU Application No. 2015208930.

* cited by examiner

PADDLE FOR WATER SPORTS

RELATED APPLICATIONS

The present application is a U.S. National Stage under 35 USC 371 patent application, claiming priority to Serial No. PCT/GB2015/050152, filed on Jan. 23, 2015, which claims priority from GB1401166.2, filed on Jan. 23, 2014, both of which are incorporated herein by reference.

FIELD OF THE INVENTION

The invention relates to the field of water sports, including both board sports and other water sports, such as scuba diving or snorkelling where a user requires to propel themselves through water.

BACKGROUND TO THE INVENTION

In board sports, such as surfing, and body-boarding, participants must propel themselves from the shore, out past the breakers, before riding the waves back to shore. This can be both difficult and tiring. There are other water sports, such as snorkelling or diving where, again, a participant requires to propel themselves.

A user might propel themselves with a paddle, for example as in the sport of kayaking. However, a paddle will then interfere with their ability to use their arms and hands. The invention relates to an improved device to enable water sports participants to propel themselves through water, while limiting the restriction on their ability to later make other use of their arms, for example while balancing on a water sports board.

In UK application 1306152.8 I have proposed a water sports board, the board having a front half and a rear half, and comprising a first foot rest, a second foot rest, a first arm support and a second arm support; the first foot rest and second foot rest slidably mounted on the rear half of the board, and the first arm support and the second arm support slidably mounted on the front half of the board; wherein the first foot rest is coupled to the first arm support and the second foot rest is coupled to the second arm support such that movement of one foot rest produces a movement of the respective arm support. Said water sports board is useful to enable a user to more readily propel themselves to the correct place to catch waves.

Some embodiments of the present invention are suitable for use with a water sports board of that type. However, the invention is not limited to devices suitable for use with a water sports board of that type.

SUMMARY OF THE INVENTION

According to a first aspect of the invention there is provided a paddle comprising a blade, a fastener for fastening the paddle to a user's forearm (an arm fastener), a gripping portion mounted to the blade wherein the blade is movable with respect to the fastener between an operating position and a stowed position.

In the operating position, a user grips the gripping portion while the fastener fastens the paddle to their forearm. In the operating position, the gripping portion is adjacent the user's hand. In the stowed position, the paddle is at least partially folded back while the fastener fastens the paddle to the user's forearm. The user's hand is preferably free of the blade when the paddle is in the stowed position. Typically, the blade is folded back by at least 90 degrees and typically at least 110, at least 120 or at least 130 degrees from the operating position to the stowed position. Preferably the blade is folded back by substantially 180 degrees from the operating position to the stowed position.

Therefore, the paddle can be worn by a user (by fastening the fastener to their forearm) and used (in the operating position) to propel the user forwards with a paddling motion. The blade can then be moved to the stowed position enabling the user to use their arms for other activities (e.g. pushing themselves to their feet on a surf board) while continuing to retain the paddle on their forearm for future use.

A user will typically wear two such paddles, one on each forearm.

The paddle may comprise a connector extending from the fastener to the blade to enable the blade to be moved with respect to the fastener between an operating position and a stowed position.

The connector may be bendable.

The connector may be flexible. The connector may comprise a hinge (for example it may be a hinged handle). A hinge can enable the connector to bend or pivot to enable the blade to be moved between the operating position and the stowed position. The connector may comprise a pin connector. Alternatively the connector may comprise a living hinge.

The connector may be located behind the wrist, in use.

Typically, the connector is bendable so that the blade can be bent or moved away from the operating position in only one plane. Typically that plane is generally in the plane of the blade. Typically, the plane is generally perpendicular to a wearer's dorsopalmar axis (axis extending through their forearm in the direction from the back of the hand to the palm, or vice versa).

Thus, when the user grips the gripping portion in the operating position and paddles using the paddle, the forces acting on the blade do not act to urge the paddle towards the stowed position. This avoids force on the wrist. This enables a greater leverage effect than would be the case if the connector was bendable away from the operating position in the same direction that the wrist flexes.

Optionally, the connector may be adapted to cause a lateral movement of the blade. In at least one embodiment of the present invention by having a connector that besides allowing movement between an operating position and a stowed position, the connector also allows a lateral movement of the blade, the blade can be folded into a stowed position which is more comfortable to the user in order to carry out other activities while the blades are folded.

The connector may comprise an helical groove. In at least one embodiment of the present invention a connector comprising an helical groove allows simultaneous deployment or folding with a lateral movement. When the blade is deployed, the blade also moves towards the arm's longitudinal axis and when the blade is folded back, the blade also moves away from the arm's longitudinal axis.

The paddle may comprise a biasing element that biases the blade towards the stowed position. In embodiments where the connector comprises a hinge, the biasing element may extend across the hinge. The biasing element is typically a resilient member, for example a spring or a resilient rope, such as an elastomeric rope or bungee. Provision of a biasing element which biases the blade towards the stowed position allows the blade to automatically move to the stowed position, and thereby free up the user's hands quickly and easily, while the user continues to retain the paddles on their arms.

Optionally the paddle may comprise a retaining element to temporarily or partially retain or fix the blade in the stowed position. In at least one embodiment of the present invention a retaining element avoids occasional movement of the blade while the blade is in the stowed position, which may be caused by sudden energic movements of the user's arm.

The retaining element may comprise a magnet and a metallic portion, one of the magnet and the metallic portion being associated with the blade and the other of the magnet and the metallic portion being associated with the fastener the magnet and the metallic portion being adapted to cooperate in the stowed position so that relative movement between the blade and the fastener is temporarily or partially impeded. Alternatively the retaining mechanism may comprise a locking mechanism, such as a clip or a ball and socket mechanism. Alternatively the retaining element may be an area of increased friction or contact between the fastener and the blade when the paddle is in the stowed position.

Optionally the paddle may comprise a retaining element to temporarily or partially retain or fix the blade in the operating position. In at least one embodiment of the present invention a retaining element to temporarily or partially fix the blade in the operating position avoids occasional movement of the blade while the blade is in the operating position. This minimises the strain on the user's wrist while paddling cause by the biasing element.

The retaining element to temporarily or partially retain or fix the blade in the operating position may comprise a magnet. Alternatively the retaining mechanism may comprise a locking mechanism, such as a clip or a ball and socket mechanism.

Preferably, the gripping portion is configured to minimise obstruction to movement past the user's hand when the blade moves from the operating position to the stowed position.

The gripping portion may be movable with respect to the blade. In at least one embodiment of the present invention a gripping portion that is movable with respect to the blade can be adjusted so that the paddle fits different hand and arm sizes.

The gripping portion may be movable with respect to the blade by rotation around an axis perpendicular to the blade. Alternatively or additionally the gripping portion may be adapted to move in a plane parallel to the blade surface.

Optionally, the paddle may comprise a bar comprising first and second end portions which extend outwards from the surface of the blade and a connecting portion which extends between the end portions, spaced apart from the surface of the blade, at least part of which functions as the gripping portion. Thus, the user can grip the bar.

Typically, the second end portion extends outwards from the blade closer to the connector, and in the direction which the blade moves to the stowed position, relative to the first end portion. Typically the first end portion is at least 5 cm and typically at least 10 cm further from the connector than the second end portion. Thus, there is space for the blade to move from the operating position to the stowed position without being blocked by a user's hand, once the user ungrips the bar and moves their hand towards the blade.

Alternatively the paddle may comprise a bar comprising an end portion which extends outwards form the surface of the blade and a connecting portion which, in use, extends parallel to the blade towards the user's hand and which functions as the gripping portion. The end portion of the bar in this embodiment is located nearest to the end of the blade furthest away from the user's hand. In at least one embodiment of the present invention by providing a gripping portion as previously described, the blade can be retracted 180 degrees from the operating position into a stowed position in which the blade remains parallel to the forearm. In this way, in the stowed position, the blade presents less impediments to the user's arm movement and therefore the user can carry out other activities without being disturbed or impeded by the paddles, when they are stowed.

The gripping portion may comprise a reinforced section. The reinforced section may comprise a metallic section. In at least one embodiment of the present invention the reinforced section prevents that the gripping section breaks apart from the blade by excessive stresses in the bar arising while paddling.

The bar may comprise a surface section of elevated friction coefficient to facilitate deployment of the paddle from the stowed position to the operating position. In at least one embodiment of the present invention by providing a bar with a surface section of elevated friction coefficient, the user can deploy the blades by leaning his arms with the stowed paddles onto a static surface. By making the high friction areas of the bars the contact points between the paddle and the static surface and moving the arms backward, so that the frictional contact between the bars and the surface causes the blades to pivot around the point of contact between the surface section of elevated friction coefficient and the static surface the user can deploy the paddles into the operating position. This is especially convenient for a surfer who might wish to deploy the paddles by using the surfboard as a surface against which to deploy the blades.

The connecting portion of the bar is preferably curved or angled, so that the middle of the connecting portion of the bar is closer to the connector than would be the case if the connecting portion of the bar extended in a straight line from the first end portion to the second end portion. The connecting portion of the bar may be generally L-shaped. In at least one embodiment of the present invention an angled connecting portion allows the hand to grip the blade with less tension caused by the biasing element.

The connecting portion of the bar may comprise a recess within which the blade is at least partially recessed in the stowed position.

The blade may comprise a curved surface. In at least one embodiment of the present invention a blade comprising a curved surface partially surrounds and protects the user's forearm when the paddle is in the stowed position and the curved surface improves and enhances the propulsion achieved when paddling in the operating position.

The blade may comprise a scalloped surface. In at least one embodiment of the present invention a blade comprising a scalloped surface creates a greater thrust when paddling.

The blade may comprise a stiff material. In at least one embodiment of the present invention a stiff material allows a greater energy conversion from the arms into movement.

The blade may comprise a flexible material. In at least one embodiment of the present invention a blade comprising a flexible material helps to avoid applying excessive force to the gripping portion while paddling and therefore avoid fracture of the paddle.

The blade may comprise a resilient material. In at least one embodiment of the present invention a blade comprising a flexible material helps to avoid applying excessive force to the gripping portion while paddling and therefore avoid fracture of the paddle and still recover some of the energy consumed in bending the blade into movement.

The blade may comprise a stiff portion and a flexible portion. The flexible portion may be located towards the outer edge of the blade. In at least one embodiment of the present invention such a configuration of the blade may maximise the energy efficiency of the paddle and also prevent excessive force to be applied or wasted during paddling.

The blade may comprise a smooth surface. In at least one embodiment of the present invention a blade with a smooth surface facilitates the paddling motion of the user by allowing the blade to easily glide with the arms from the back position to the forward position.

The blade may comprise a dimpled surface. In at least one embodiment of the present invention a blade with a dimpled surface facilitates the paddling motion of the user by allowing the blade to more easily glide the arms from the back position to the forward position.

The blade may be adapted to provide increased or decreased resistance to paddling. In at least one embodiment of the present invention a blade which resistance to paddling can be modified can be used by users of different strengths, such that the force required to paddling can be modified and adapted to different users.

The blade may comprise plurality of holes on its surface and a movable obturating screen. In at least one embodiment of the present invention a blade comprising holes and a movable obturating screen can be used to modify the resistance to paddling by regulating the obturation of the holes in the blade surface with the movable screen.

The blade may be adapted to permit liquid flow through it in only one direction. In at least one embodiment of the present invention a blade that permits liquid flow through it in one direction can propel the user while paddling and facilitates the return movement of the arm beneath the water surface after a paddle stroke.

The blade may comprise a plurality of apertures, the apertures comprising membranes that allow liquid flow in only one way through them. In at least one embodiment of the present invention a blade as described before can reduce the energy needed in the return movement of the arm after a paddling stroke.

The fastener may comprise a hook and loop type fastener, such as VELCRO®. The fastener may comprise a buckle-type fastener. The fastener may comprise a tie such that the paddle may be tied to the forearm of the user. The fastener may comprise an arm strap through which a user may fit their forearm.

The paddle may comprise a plurality of fasteners. The paddle may comprise a first fastener and a second fastener which are spaced apart along the length of the paddle when the paddle is in the operating position (i.e. spaced apart along the user's forearm when the paddle is fastened to their forearm). The provision of a paddle which may be fastened to the arm of the user at two spaced apart points on the arm of the user to provide stability to the paddle during use. For example, the provision of a first fastener and a second fastener prevents rotation of the paddle on the arm of the user during use.

The fastener may be padded. In at least one embodiment of the present invention a padded fastener is more comfortable to wear and will cause less damage to the user through prolonged and intensive use. This is especially important when the hand is at right angles with the forearm. A padded fastener is also helpful to avoid the tendency of the fastener to come out of the forearm while paddling.

According to a second aspect there is provided a water sports board, the board having a front half and a rear half, and comprising a first foot rest, a second foot rest, a first arm support and a second arm support; the first foot rest and second foot rest slidably mounted on the rear half of the board, and the first arm support and the second arm support slidably mounted on the front half of the board; wherein the first foot rest is coupled to the first arm support and the second foot rest is coupled to the second arm support such that movement of one foot rest produces a movement of the respective arm support.

Typically, with known water sports, a user lies on their front on the board and uses their arms to propel the board through the water. With the present invention, a user may lie on the board, with their arms in contact with the arm supports, such that their arms (or possibly paddles held by the user or attached to their arms) extend into the water, and to push one or both foot rests, thereby causing forces to be applied to their arms by the arm supports, which in turn cause their arms (or paddles attached thereto) to push against the water in a rearwards direction, driving the water sports board forwards. Therefore, the provision of foot rests, the movement of which is coupled to the movement of arm supports allows the power of a user's arms to propel the board through the water to be supplemented (or replaced) by the power of the user's legs. Typically, the legs of a person are stronger than the arms of that person. Therefore, the legs of a person typically can produce more power than the arms of that person.

Accordingly, the ability to supplement (or replace) the power generated by the user's arms to propel the board through the water using power generated by the user's legs allows the user to propel the board more effectively and comfortably. Therefore, a board according to the present aspect of the invention may allow the user to propel the board through the water faster and with less effort than would otherwise be the case resulting in the user being fresher, or less tired, when they reach their destination, and therefore able to enjoy their chosen water sport to a greater extent.

Typically, rearward movement of one of the foot rests is coupled to rearward movement of the corresponding armrest. The path of movement of the foot rests need not be parallel to a longitudinal axis of the board and may have a lateral component, or even possibly describe a curve. Similarly, the path of movement of the arm supports need not be parallel to a longitudinal axis of the board and may have a lateral component, for example, said paths may describe a curve such as an arc. In embodiments where the path of the or each arm support describes an arc, the axis of the arc may be located adjacent the shoulder of the user.

Typically, the user synchronises the movement of their arms with the movement of their legs. In this way, the coupling of the movement of the first and second foot rests to the movement of their respective arm supports allows the user's arms to be pushed by the arm rests, thereby providing more power to the stroke. Alternatively, the synchronous movement allows the legs of the user to partially or fully power the movement of the user's arms, thereby allowing the user to provide less power from their arms, for the same propulsion produced.

In this way, the action of the arm rests, responsive to the user pushing on the foot rests, may enhance the strokes of the user to propel the board through the water.

The first and second arm supports may be curved. The first and second arm supports may be curved towards the rear of the board such that the user's arms are supported within the curve of the first and second arm supports. The first and second arm supports may be arranged such that the user's arm (for example their inner elbow or upper arm) is located adjacent to the respective arm support.

The first and second foot rests may comprise a first portion against which the user can push to move the foot rest, and a second portion operable to retain the user's foot close to or against the first portion of the foot rest. In this way, the user may push against the first portion to supplement the movement of one arm lying against the first arm support when producing a stroke. The user may then pull against the second portion with their foot to return the foot rest (and thereby the first arm support) to its original position, ready for a second stroke.

Typically, the first foot rest and the first arm support are slidably mounted on the same side of the board (i.e. the left side or the right side of the board viewed from the top surface of the board, which a user lies on in use), and the second foot rest and the second arm support are slidably mounted on the same side of the board such that movement of the left foot of the user supplements the movement of the left arm of the user, and movement of the right foot of the user supplements the movement of the right arm of the user.

However, in alternative embodiments, the first foot rest may be slidably mounted on the opposite side of the board to the first arm support such that movement of the left foot of the user supplements the movement of the right arm of the user, for example, and the second foot rest may be slidably mounted on the opposite side of the board to the second arm support such that movement of the right foot of the user supplements the movement of the left arm of the user.

The first foot rest and/or the second foot rest may be slidably mounted to the board. The first foot rest and/or the second foot rest may be configured such that during use the foot of the user retained in the first foot rest and/or the foot of the user retained in the second foot rest is oriented at an angle to the top surface of the board. The first foot rest and/or the second foot rest may be configured such that during use the foot of the user retained in the first foot rest and/or the foot of the user retained in the second foot rest is oriented at an angle of at least 20 degrees to the top surface of the board, at least forty degrees to the top surface of the board, or preferably at least 40 degrees to the top surface of the board. For example, during use the foot of the user retained in the first foot rest and the foot of the user retained in the second foot rest may be oriented at an angle of 45 degrees to the top surface of the board.

The provision of a first foot rest and/or a second foot rest which is configured such that the feet of the user are oriented at an angle to the top surface of the board provides a more comfortable position for the user to adopt when using the board.

The first arm support and/or the second arm support may be configured to fold into the board once the user has propelled the board to the desired location. The first arm support and/or second arm support may be configured to retract into the board once the user has propelled the board to the desired location. In this way, the top surface of the board may comprise fewer obstructions to hinder the user during participation in the water sport of their choice.

The board may comprise a brace to resist sliding of a user along the board while they press either or both foot rests. The brace may be located on the front half of the board. The brace may be located such that during use the shoulders of the user are in contact with the brace and the arms of the user are in contact with the first and second arm supports. The brace is typically located on the centre line of the board (i.e. the line running down the middle, from the back of the board to the front). The first and second arm supports are typically located on opposite sides of, and spaced apart from, the centre line of the board. The brace may be located forwards of the first and second arm supports or the brace and the first and second arm supports may be arranged in a line extending transversely across the board.

Preferably, the brace is a shoulder brace, for example it may comprise left and right shoulder engaging formations. During use, the head of the user may be inserted or rested against the shoulder brace such that the shoulders of the user abut the shoulder brace. Alternatively, the brace may comprise a chest support.

The provision of a brace enables the user to push the foot rests without slipping, thereby allowing the board to be propelled with greater force than would otherwise be the case. This can be especially important as water sports boards typically become wet during use.

In embodiments where the brace is a chest support, the chest support may comprise a chest engaging surface which extends forwardly and upwardly. (By forwardly and upwardly we refer to directions relative to the orientation of the board in normal use on water). A chest support which extends forwardly and upwardly allows the user's upper body to be raised from the waist to the shoulders. The chest support may extend forwardly and upwardly over a longitudinal distance of at least 10 cm to provide gradual incline. The chest support may be wedge shaped. The chest support may raise the user's head and upper body, thereby allowing the user to more readily look in the direction they are travelling whilst providing a better angle for the arms of the user to propel the board through the water.

The board may be a surf board. The board may be a body-board. The board may be a body-board comprising a viewing port. The viewing port may allow the user to look through the board, below the surface of the water.

The board may be a rescue board (i.e. a water sports board which is suitable for use by life guards or similar to rescue swimmers in distress). The board may comprise handholds for rescued swimmers to grip the board.

The board may be adapted to be propelled through the water whilst the board is submerged or partially submerged, for example it may have a buoyancy such that it will typically be submerged or partially submerged during normal use. The board may be adapted to be propelled through the water whilst the user is submerged or partially submerged.

The first foot rest may be coupled to the first arm support via a coupling member. The second foot rest may be coupled to the second arm support via a coupling member. The first foot rest may be coupled to the first arm support via a coupling member and the second foot rest may be coupled to the second arm support via a coupling member.

At least one coupling member may comprise a rod. Preferably, the rod of the at least one coupling member may be flexible. The rod of the at least one coupling member may be rigid.

The at least one coupling member may comprise a plurality of rods. For example, the at least one coupling member may comprise two, three or four rods. Preferably, the rods within the plurality of rods are coupled to each other to allow movement of the first or second foot rest to be coupled to the first or second arm support respectively.

The at least one coupling member may comprise a pneumatic system.

Preferably, each of the at least one coupling member is mounted to the board. The at least one coupling member may be mounted to the board in such a way that the at least one coupling member is movable relative to the board.

Preferably, the at least one coupling member is mounted to the board such that the coupling member is movable longitudinally along the board.

For example, the at least one coupling member may be a rod mounted to the board via a tube that allows the rod to travel along the tube. Alternatively, the at least one coupling member may be a rod mounted to the board via a rail or similar.

The at least one coupling member may be mounted within the board. The at least one coupling member may be recessed within the board. It may be that at least half of the coupling member is retained within the board during use. It may be that at least two thirds of the coupling member is retained within the board during use.

The provision of a recessed coupling member, or a coupling member retained within the board allows the board to be freer of obstructions that may hinder the user when participating in the water sport of their choice.

The first foot rest and/or the second foot rest may be slidably mounted to the rear half of the board via the at least one coupling member. The first arm support and/or the second arm support may be slidably mounted to the front half of the board via the at least one coupling member.

The at least one coupling member may be biased towards a first position, such that movement of the coupling member away from the first position is resisted. For example, the at least one coupling member may be biased towards a first position corresponding to a position where the respective foot rest is at its most forward position on the board. Alternatively, the at least one coupling member may be biased or resiliently biased towards a first position corresponding to a position where the respective foot rest is at its most rearward position. The most forward position would typically correspond to a location where during use a user's legs are drawn towards their body. The most rearward position would typically correspond to a location where during use a user's legs are fully extended or most extended. The at least one coupling member may be biased by a resilient member, such as a spring.

Typically, the first foot rest and the second foot rest move independently such that movement of the first foot rest and first arm support is independent of movement of the second foot rest and second arm support.

However, it may be that the first foot rest and the second foot rest are coupled (for example, by a coupling element which extends between the first foot rest and the second foot rest, or between the first arm support and the second arm support, or between the coupling elements coupling the first arm support to the first foot rest and the second arm support to the second foot rest) such that the first foot rest and the second foot rest move together, and movement of the coupled first and second foot rests produces movement of the first and second arm supports.

The first foot rest and the second foot rest may be coupled such that the first foot rest and the second foot rest move in opposite directions.

It may be that the board of the present aspect of the invention allows the user to propel the board through the water at least fifty percent faster than a standard board for the same energy expended. The board of the present invention may allow the user to propel the board through the water at least one hundred percent faster than a standard board for the same energy expended. The board of the present aspect of the invention may allow the user to propel the board at least one hundred and fifty percent faster than a standard board for the same energy expended. The board of the present invention may allow the user to propel the board at least two hundred percent faster than a standard board for the same energy expended.

The board may comprise a raised surface such that during use, the pelvis of the user is raised. The raised surface may provide a more comfortable surface for the user to lie upon during use.

It may be that the majority of the top surface of the board comprises an anti-slip surface to allow the user to obtain purchase on the board during use in the water sport of choice. That is, the majority of the top surface may provide a high friction surface to allow the user to obtain grip on the board. The top surface of the board may comprise at least one area that comprises a low friction surface. Preferably, the at least one area comprising a low friction surface is located during use adjacent to the knees of the user such that the knees of the user may slide along the at least one portion during each stroke. The at least one area may comprise a first area located on one side of the board and a second area located on the opposed side of the board, such that during use one knee of the user rests on the first area and the other knee of the user rests on the second area. Alternatively, the at least one area may comprise a single area that extends across the top surface of the board and during use both knees of the user rest on the single area.

The provision of a low friction surface adjacent to the knees of the user during use allows the knees of the user to freely slide across the surface of the board to ensure that the minimum energy is expended in moving the knees of the user across the board, and therefore, allows more energy to be used to move the first and/or second foot rests.

According to a third aspect of the invention, there is provided a paddle for use with a board according to the second aspect, comprising a blade, a handle opposed to the blade, a fastener adjacent to the handle, and a gripping portion adjacent to the blade, wherein the paddle is mountable to the forearm of a user such that the handle is oriented along the user's forearm and the user's hand is located adjacent to the gripping portion.

The handle is preferably a bendable connector. Further optional features of the third aspect of the invention correspond to those discussed above in respect of the first aspect of the invention.

If a user wishes to propel a board across a body of water, they typically are required to either use their hands or to bring an implement such as a paddle or similar. If the user propels the board with their hands, the board will typically be propelled slowly due to the low surface area of the user's hands and arms only being able to push against a small volume of water. If a paddle is used, the user can more readily propel the board at a higher velocity for the same energy expended due to the larger surface area of the paddle blade. However, if the user then wishes to use the board to body board or surf, the user is left with a cumbersome paddle that must be held or otherwise retained.

The provision of a paddle that may be mounted to the forearm of the user via the fastener and gripped by the user adjacent to the blade of the paddle allows the user to propel the board effectively, whilst at the same time ensuring that should the user wish to use the board, the paddle is already secured in such a way as to not interfere.

The fastener may comprise a hook and loop type fastener, such as VELCRO®. The fastener may comprise a buckle-type fastener. The fastener may comprise a tie such that the paddle may be tied to the forearm of the user.

The paddle may comprise a plurality of fasteners. The paddle may comprise a first fastener and a second fastener which are spaced apart along the length of the paddle when the blade is in the operating position (i.e. spaced apart along the user's forearm when the paddle is fastened to their forearm). The provision of a paddle which may be fastened to the arm of the user at two spaced apart points on the arm of the user to provide stability to the paddle during use. For example, the provision of a first fastener and a second fastener prevents rotation of the paddle on the arm of the user during use.

Preferably, the user is provided with a paddle according to the invention on each forearm. In this way the user may utilise both arms to propel the board through the water.

The gripping portion may comprise a grip (e.g. a handle) and during use the user may grip the grip (e.g. a handle). The gripping portion may comprise a pouch and during use the user may insert their hand into the pouch.

The provision of a gripping portion allows the user to obtain good purchase of the blade of the paddle and thereby the user may more effectively drive the blade of the paddle through the water. In this way, the user may propel a board faster and more effectively than would otherwise be the case.

According to a fourth aspect of the invention, there is provided a method of use of a water sports board, comprising the steps:

providing a water sports board according to the second aspect of the invention;

a user lying on the board such that the first foot of the user is in contact with the first foot rest, the second foot of the user is in contact with the second foot rest, and the first arm of the user is resting against the first arm support and the second arm of the user is resting against the second arm support;

the user pushing against the first foot rest of the board with a first foot to move the first foot rest from a first position to a second position;

the first arm support pushing against the first arm of the user to drive the first arm of the user through the water; and moving the first foot rest from the second position to the first position.

Preferably, the method of use further comprises the steps:

the user pushing against the second foot rest of the board with a second foot to move the second foot rest from a first position to a second position;

the second arm support pushing against the second arm of the user to drive the second arm of the user through the water; and moving the second foot rest from the second position to the first position.

The steps of moving of the first foot rest and the second foot rest may be carried out one after the other (sequentially), or at the same time (synchronously).

It may be that pushing against one foot rest pushes both arms of the user to drive both arms of the user through the water.

Preferably, the method comprises the step of mounting a first paddle to the first arm of the user, and the movement of the first foot rest from the first position to the second position drives the first paddle through the water.

Preferably, the method comprises the step of mounting a second paddle to the second arm of the user, and the movement of the second foot rest from the first position to the second position drives the second paddle through the water.

The said paddles may be paddles according to the first aspect of the invention. The said paddles may be paddles according to the third aspect of the invention. The method may comprise paddling using the paddles with the blades in the operating position and then moving the blades to the stowed position, without removing the paddles from their arms.

Therefore, the method may enhance the strokes of the user to propel the board through the water.

Where the water sports board is a surf board, the method may comprise the step of subsequently surfing on the water sports board, which may be carried out with the first and/or second paddles remaining mounted to a user's arm or arms.

According to a fifth aspect of the invention, there is provided apparatus (a kit of parts) comprising a board according to the second aspect of the invention, and at least one paddle according to the first or third aspects of the invention.

Preferably, the paddles of the first or third aspects of the invention are used together with a board of the second embodiment of the invention. In this way, the additional power provided by the coupling of the arm movement to the leg movement of the user is amplified by the greater surface area afforded by the paddles of the second aspect of the invention such that the user is able to propel the board through the water at a greatly increased rate.

It may be that the use of the board of the second aspect and the paddles of the first or third aspects provides a greater increase in power applied to the water by the user than either one alone.

Preferably, the apparatus comprises a board according to the second aspect of the invention and two paddles according to the first or third aspects of the invention.

Preferably, the apparatus is used by the method of the fourth aspect of the invention.

According to a sixth aspect of the present invention there is provided a paddle comprising a blade, a fastener for fastening the paddle to a user's forearm (an arm fastener), a gripping portion mounted to the blade and a connector extending from the fastener to the blade, wherein the connector is bendable to enable the blade to be moved between an operating position and a stowed position.

According to a seventh aspect of the present invention there is provided a method of deploying a paddle attached to a user's arm from a stowed position to a deployed position, the paddle comprising a blade and a fastener, the paddle being attached to the user's arm by the fastener, and the blade being movable with respect to the fastener, the method comprising the steps of:

engaging a portion of a paddle with a surface, and moving the arm to create relative movement between the fastener and the blade such that the blade moves to the deployed position.

It will be understood that preferred, optional or alternative features of one aspect may also be applicable to one or more of the other aspects and have not been repeated for brevity.

DESCRIPTION OF THE DRAWINGS

An example embodiment of the present invention will now be illustrated with reference to the following Figures in which.

DETAILED DESCRIPTION OF AN EXAMPLE EMBODIMENT

Figure 1:
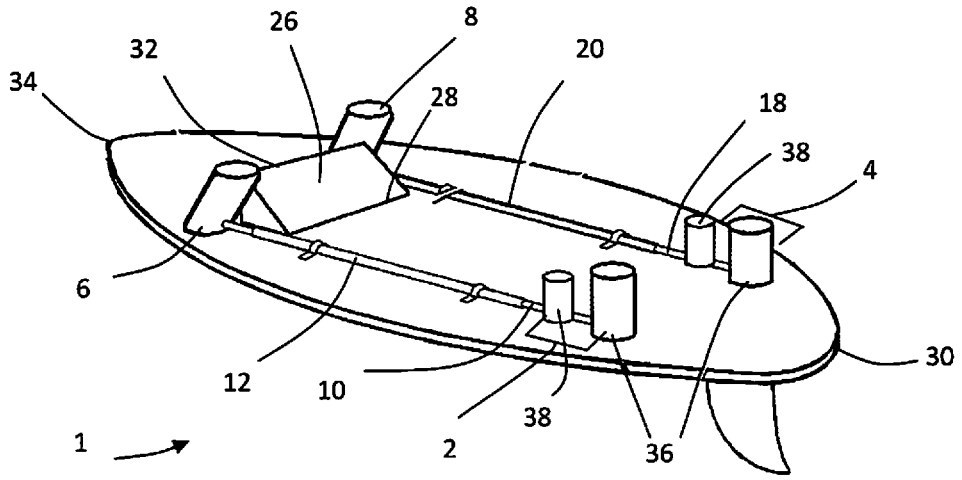
FIG. 1 is a perspective view of a board according to one embodiment of the invention.
Figure 2:
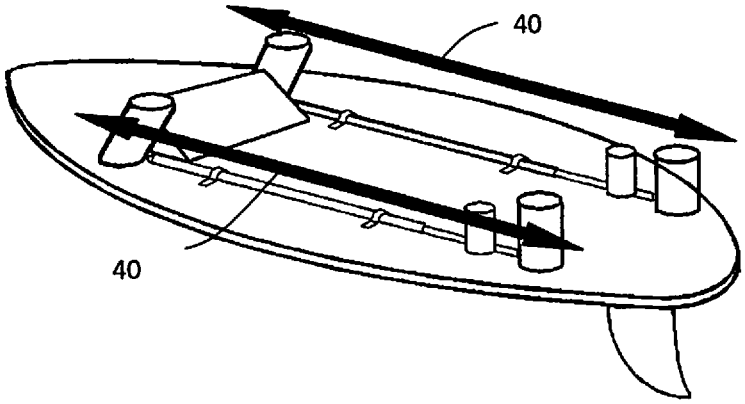
FIG. 2 is a perspective view of a board according to one embodiment of the invention.
Figure 3:
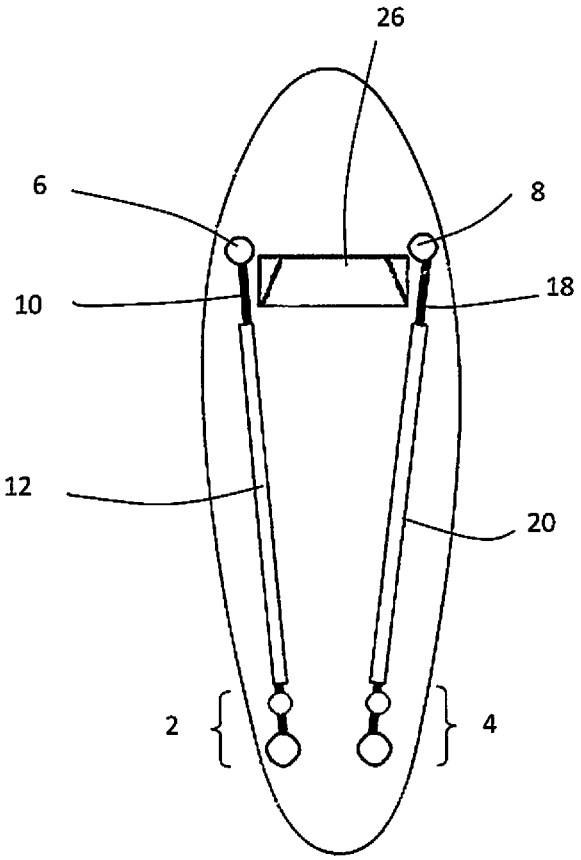
FIG. 3 is a top view of the board of FIGS. 1 and 2.

With reference to FIGS. 1 to 3, a board 1 comprises a first foot rest 2, a second foot rest 4, a first arm support 6 and a second arm support 8. The first and second foot rests are in the rear half of the board.

The first and second arm supports are in the front half of the board. The first arm support and second arm support are curved towards the rear of the board such that a user's inner elbow may rest within the curve of the arm support. The first foot rest and the first arm support are located on the left side of the board (viewed from above the board in normal use, facing forwards), and the second foot rest and the second arm support are located on the right side of the board.

The first foot rest is coupled to the first arm support by a first flexible rod 10 (acting as a coupling member). The first flexible rod is mounted to the board via a tube 12 that allows the rod to move from a first position 14 to a second position 16. The second foot rest is coupled to the second arm support by a second flexible rod 18 (acting as a coupling member). The second flexible rod is mounted to the board via a tube 20 that allows the second flexible rod to move from a first position 22 to a second position 24. The first foot rest is movable along a first path and the second foot rest is movable along a second path.

Accordingly, longitudinal movement 40 of the first foot rest along the first path moves the first flexible rod along the tube, which thereby moves the first shoulder rest, and the movement of the second foot rest along the second path moves the second flexible rod, which thereby moves the second shoulder rest.

The board further comprises a chest support 26 (acting as a brace) mounted between the first and second arm supports. The chest support comprises a wedge-shaped support oriented with the thin end of the wedge 28 towards the rear of the board 30, and the thick end of the wedge 32 towards the front of the board 34. Accordingly the chest support has an upper surface which extends forwardly and upwardly.

The first and second foot rests comprise a foot seat 36 (acting as a first portion against which the user may push to move the first and second foot rests respectively) and a foot retainer 38 (acting as a second portion operable to retain the user's foot against the first portion of the foot rest).

Figure 4:
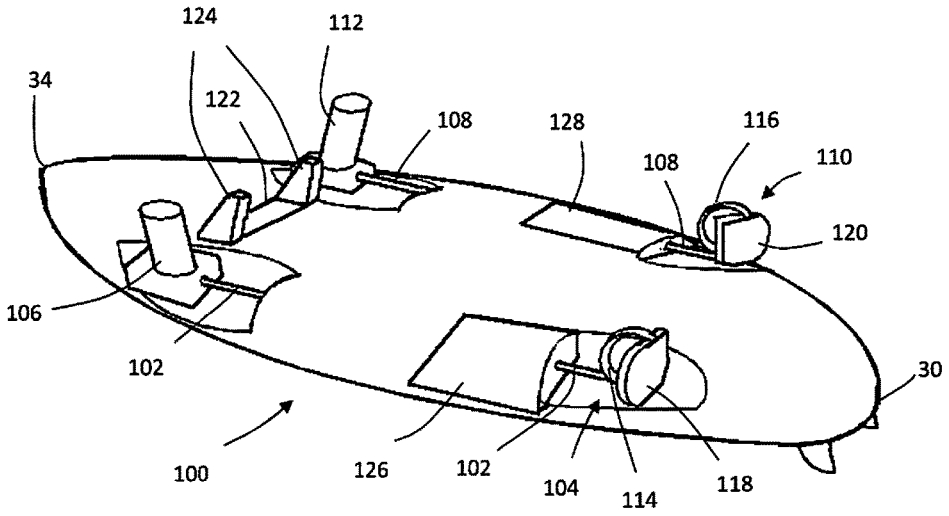
FIG. 4 is a perspective view of a board according to one embodiment of the invention.

An alternative example of the board is shown in FIG. 4. The first flexible rod 102 coupling the first foot rest 104 to the first arm support 106 and the second flexible rod 108 coupling the second foot rest 110 to the second arm support 112 are embedded within the board 100. The first and second foot rests comprise straps 114, 116 (acting as a second portion operable to retain the user's foot against the first portion of the foot rest) and foot plates 118, 120 (acting as first portions against which the user may push to move the first and second foot rests respectively). The board comprises a shoulder brace 122 (acting as a brace) having a shoulder supports 124 against, and is located between the first and second arm supports.

The top surface of the board comprises an anti-slip surface that provides additional grip to the user. In addition, the board comprises two areas 126, 128 that do not comprise an anti-slip surface. During use, the knees of the user rest on these two areas such that the knees of the user may more freely slide over the surface of the board during a stroke.

Figure 5:
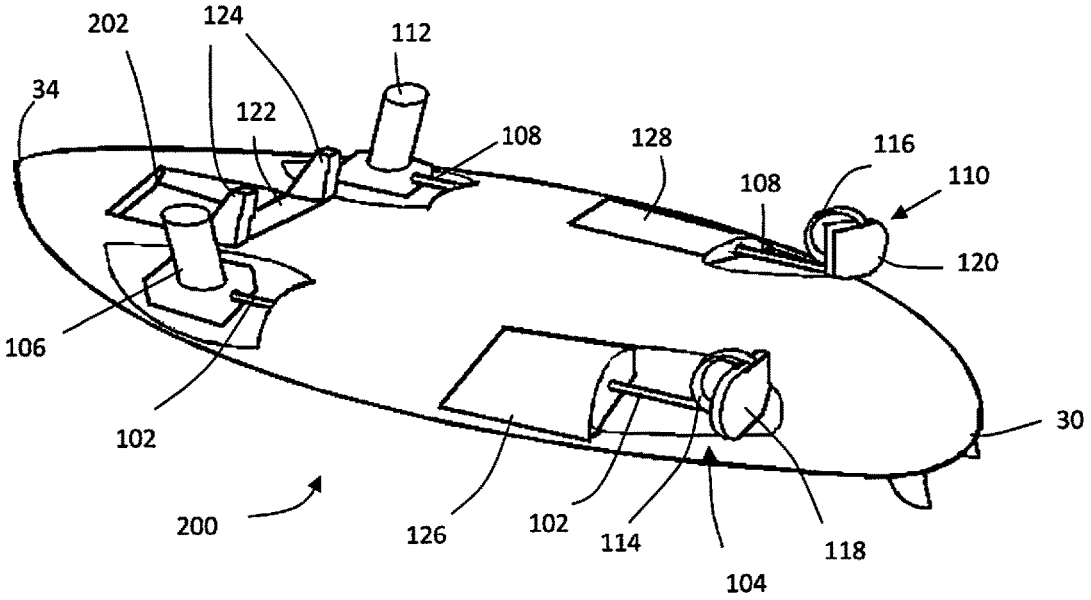
FIG. 5 is a perspective view of a board according to one embodiment of the invention.

A further alternative example of the board is shown in FIG. 5. The board 200 comprises the features of the example shown in FIG. 4, with the addition of a view port 202 through which the user may view beneath the surface of the water. For example, the board may be particularly effective in clear, shallow water to view fish and sea bed.

Figure 6:
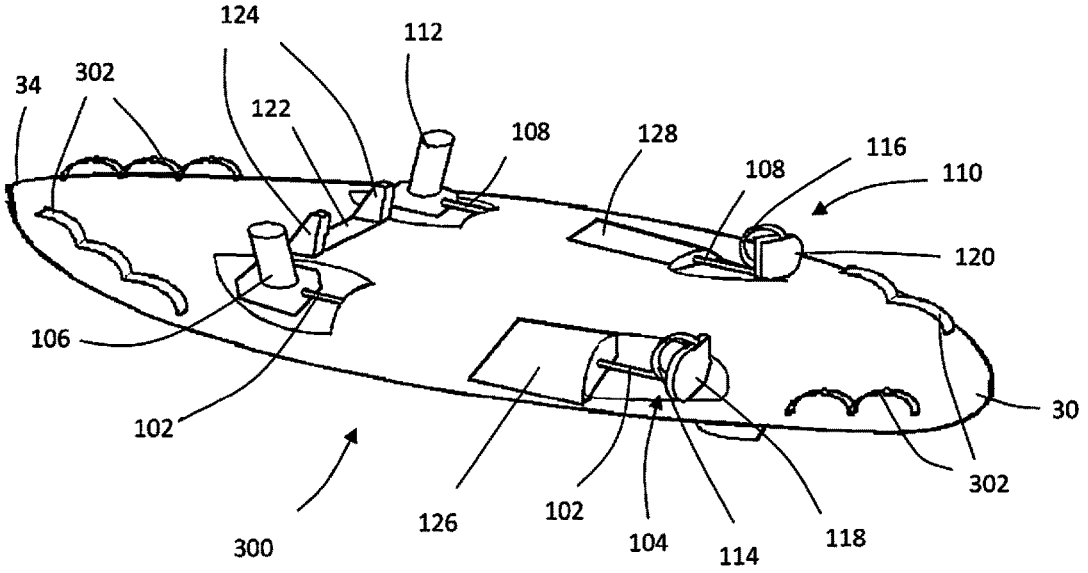
FIG. 6 is a perspective view of a board according to one embodiment of the invention.

Another example of the board is shown in FIG. 6. The board 300 is suitable for use by lifeguards in coastal regions, such as beaches, for example. In addition to the features of the board shown in FIG. 4, the board comprises handles 302 arranged around the periphery of the board to allow swimmers to hold on to once they have been rescued by the lifeguard, for example. The board is longer than the boards of FIGS. 4 and 5.

Figure 11A:
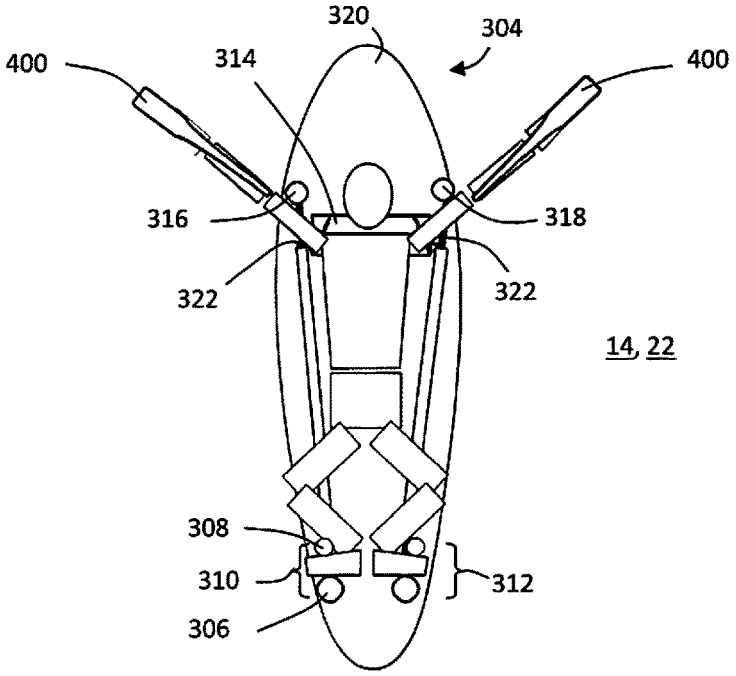
FIGS. 11(*a*) and (*b*) are top views of a board according to one embodiment of the invention being operated by a user.
Figure 11B:
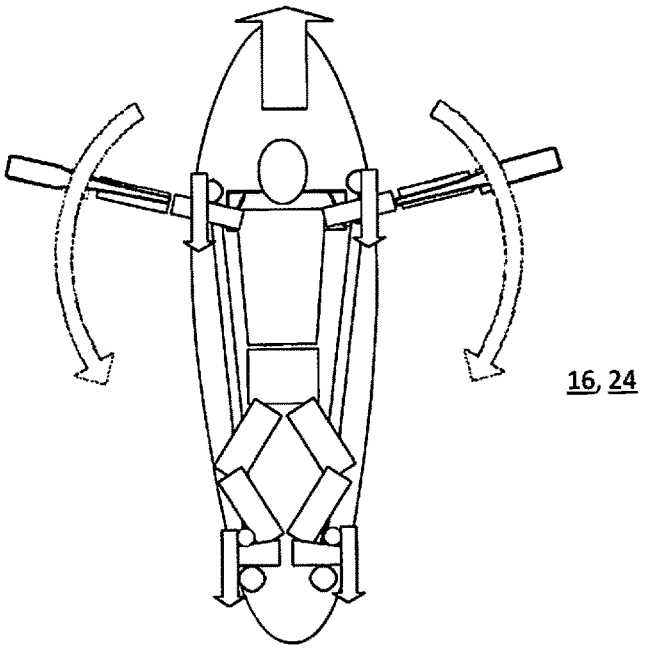

During use, with reference to FIGS. 11*a* and 11*b*, the user lies face down on the board 304, with their feet between the foot seat 306 and foot retainer 308 of the first 310 and second 312 foot rests, their chest against the chest support 314, and the inner elbow of each arm resting against the first 316 and second 318 arm supports (shown in FIG. 11*a*, for example).

The user may then paddle the board forward using their arms as normal. However, if the user requires a more powerful stroke, the user pushes against the foot rests with their feet. The foot rests then move towards the rear of the board, causing the respective arm supports to move towards the rear of the board via the flexible rods. In this way, the arms of the user are pushed towards the rear of the board by the respective arm supports, providing supplementary power to the user's stroke.

Once the stroke is complete, the user pulls their feet towards the front of the board 320. Each foot pulls against the respective foot retainer to move the foot rest towards the front of the board. The movement of the foot rest moves the attached flexible rod 322 which thereby moves the attached arm support. In this way, the arm supports are returned to their original position, ready to begin the next stroke.

Figure 13:
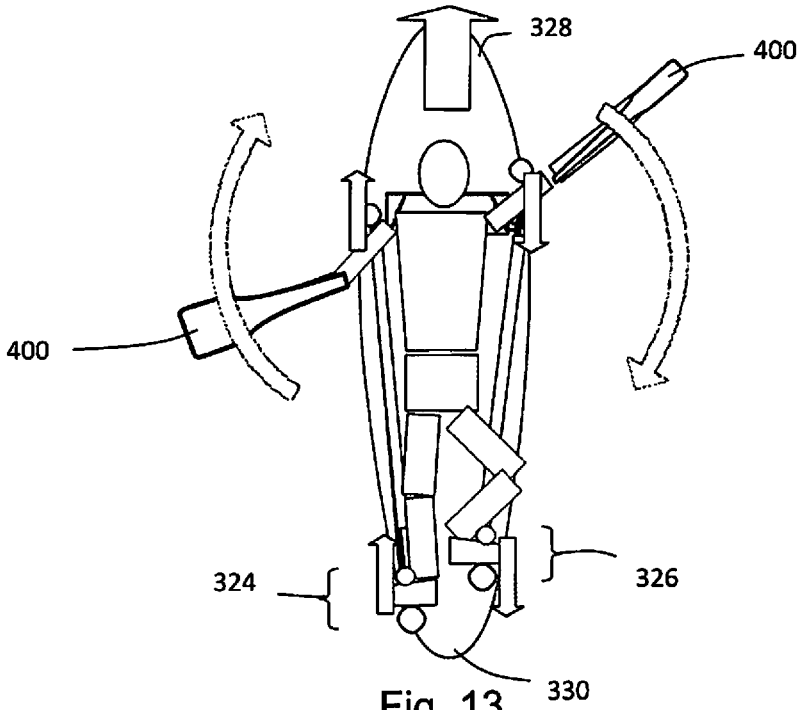
FIG. 13 is a top view of a board according to an embodiment of the invention being operated by a user.
Figure 14:
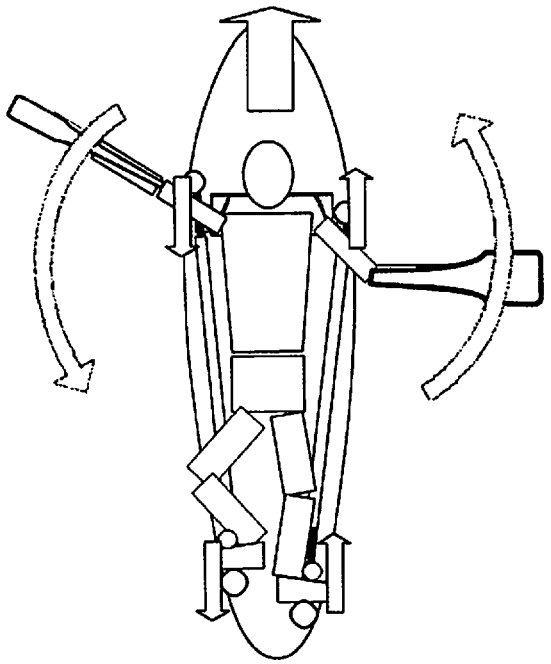
FIG. 14 is a top view of a board according to an embodiment of the invention being operated by a user.

Alternatively, with reference to FIGS. 13 and 14, the user may move the foot rests 324, 326 asynchronously, such that the movement of the first foot rest 324 is opposed to that of the second foot rest 326. For example, when the first foot rest is moved by the user towards the front of the board 328, the second foot rest is moved by the user towards the rear of the board 330.

Figure 7:
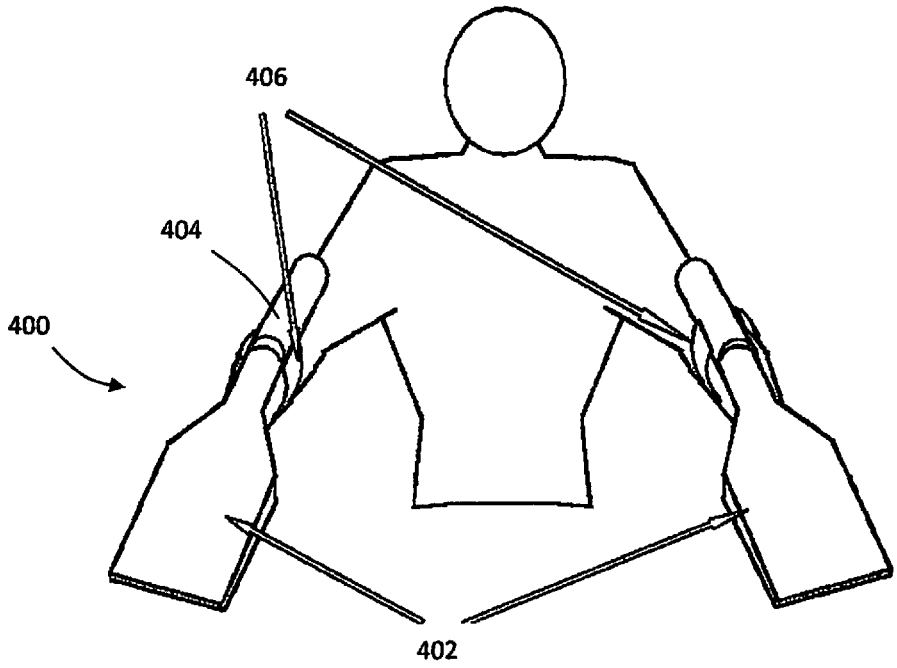
FIG. 7 is a front perspective view of a pair of paddles according to one embodiment of the invention fastened to a user.
Figure 8:
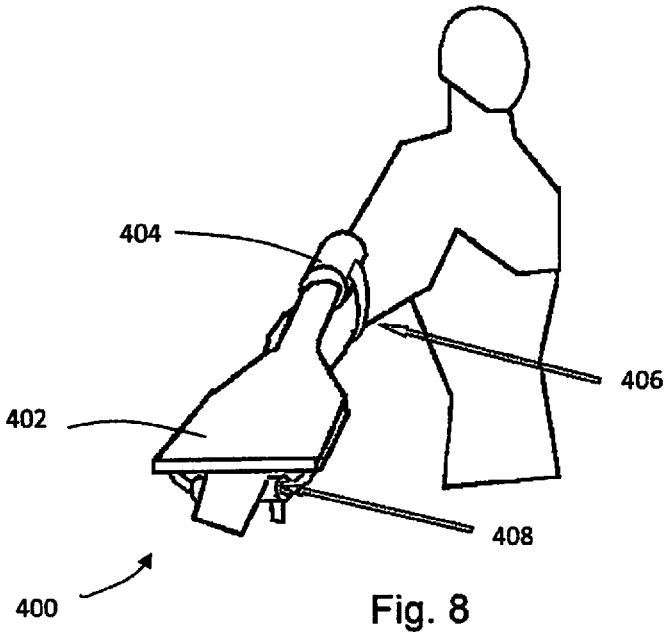
FIG. 8 is a side perspective view of a paddle according to FIG. 4 fastened to a user.

With reference to FIGS. 7 and 8, a paddle 400 suitable for use with the board of FIGS. 1 to 6 comprises a blade 402 and a handle 404. The handle comprises an arm strap 406 (acting as a fastener). The blade comprises a grip 408 (acting as a gripping portion). The arm strap comprises a hook and loop type fastener.

In alternative embodiments, the arm strap comprises a buckle type fastener or a tie.

The paddle is attached to the forearm of a user by orienting the paddle such that the handle of the paddle is along the user's forearm and the blade is adjacent to the hand of the user. The handle is then strapped to the user's forearm and the user may grasp the grip of the blade.

In this way, the user is provided with a paddle to enable them to more effectively propel a board such as a surf board, whilst allowing the user to use their hands when required without having to store the paddle first to free the user's hands.

Most advantageously, a user is provided with two paddles and a paddle attached to each arm to enhance the stroke made by each arm when propelling a board such as a surf board.

Advantageously, the paddles of this embodiment can be used in combination with the board of the first embodiment to allow the user to provide both a convenient way to use a paddle (or two paddles if one is attached to each arm) and to supplement the power of their strokes with the power of their legs.

Figure 12:
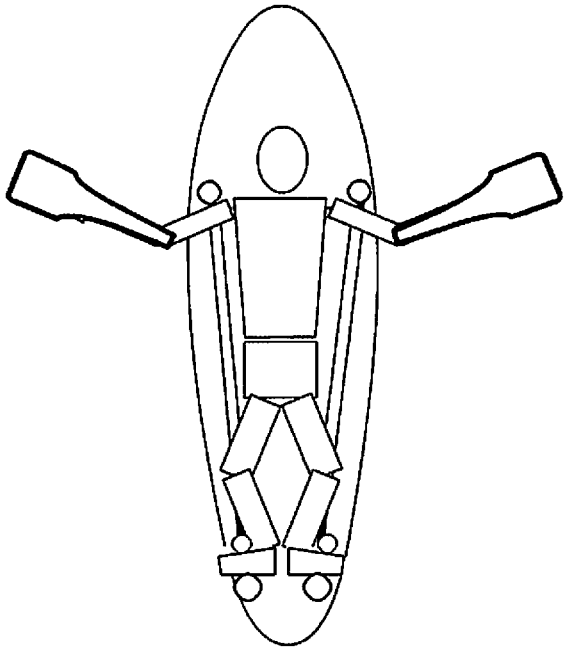
FIG. 12 is a top view of a board according to an embodiment of the invention being operated by a user.

For example, FIGS. 11*a*, 11*b* and 12 show the board of the first embodiment being used in combination with the paddles of this embodiment. In this example, the user is moving both feet and arms synchronously to drive the paddles mounted on the user's left and right arms through the water at the same time. In this way the user's arms move in strokes similar to those used when a user is swimming using the butterfly stroke.

FIGS. 13 and 14 show the board of the first embodiment being used in combination with two paddles of this embodiment. FIG. 13 shows the user moving the left foot and arm forward whilst moving the right foot and arm backward and the paddle attached to the right arm is being driven through the water. FIG. 14 shows the user moving the right foot and right arm forward whilst moving the left foot and arm backward, and the paddle attached to the left arm is being driven through the water. In this way the user's arms move in strokes similar to those used when a user is swimming using the front crawl stroke.

Once the user has reached their destination, the user may stand up on the board and, in embodiments where the board is a surf board, surf back to shore, without having to remove the paddles, or to stow the paddles away, either fixing them to the board or otherwise. In this way, the user may transition from propelling the board to surfing very quickly. In addition, the user does not need to be concerned about whether the paddles have been stowed correctly.

Furthermore, the paddles, or the handles of the paddles, are typically shorter than conventional paddles or rowing oars, as the user's arms function as extensions of the paddle handle.

Figure 9A:
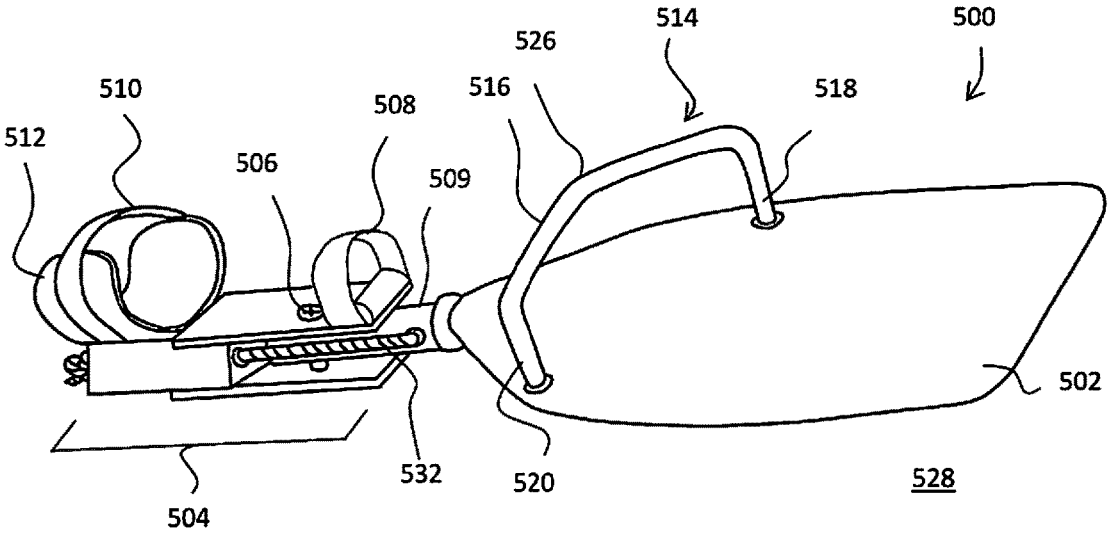
FIG. 9 is a side perspective view of a paddle according to one embodiment of the invention in an operating position (*a*) and in a stowed position (*b*)
Figure 9B:
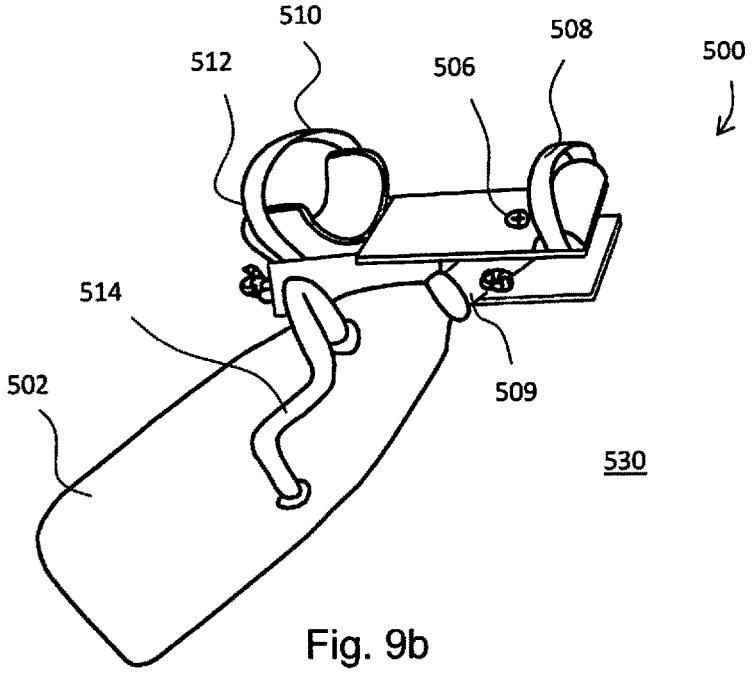
Figure 10A:
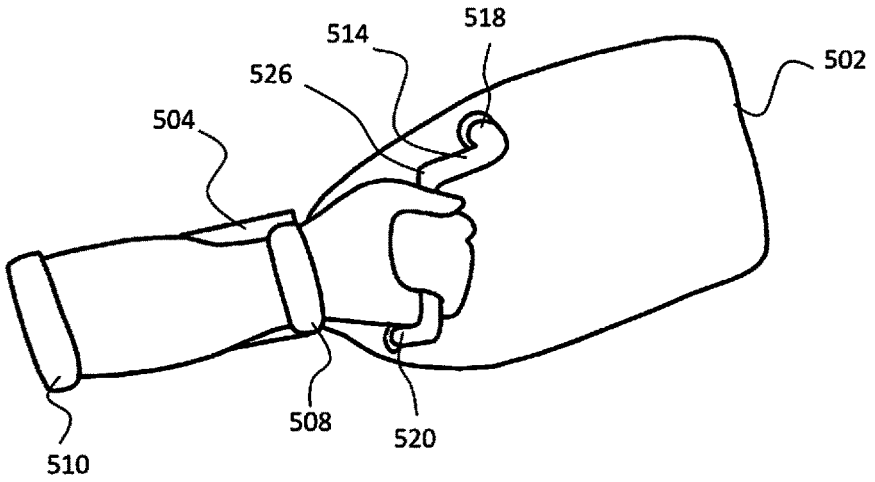
FIG. 10 is a side view of a paddle according to one embodiment of the invention in the operating position when gripped by the user (*a*), in the operating position when released by the user (*b*) and in the stowed position (*c*)
Figure 10B:
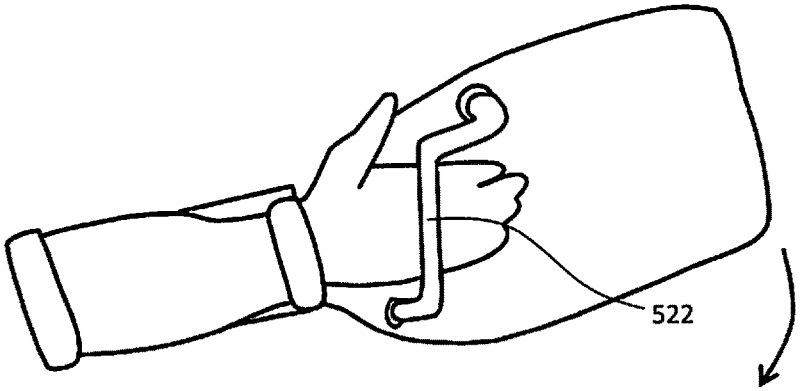
Figure 10C:
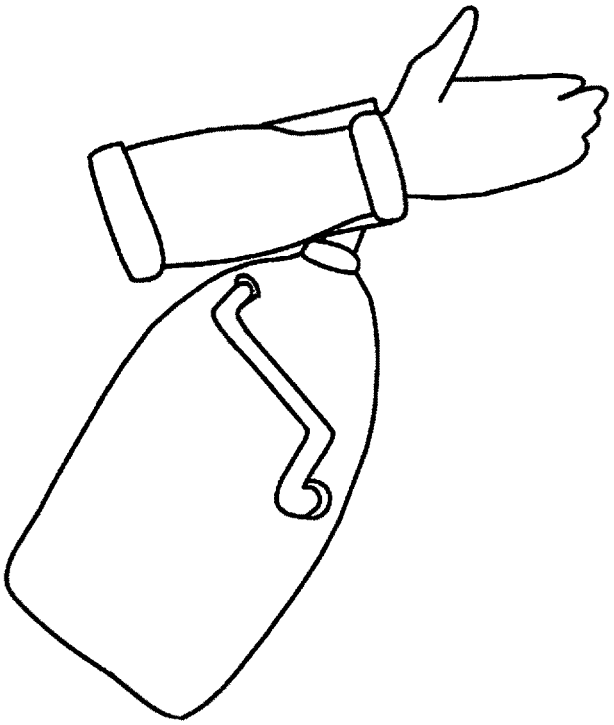

With reference to FIGS. 9 and 10, the invention provides a paddle 500 which is especially useful with the board of FIGS. 1 through 6, and which is also useful for other sports in which it is necessary for a person to propel themselves through water, such as snorkelling or scuba diving.

The paddle 500 comprises a blade 502 and a handle 504. The handle is connected through a hinged joint 506 to a stem 509 which is in turn connected to the blade. The handle, stem and hinged joint function as the connector which is bendable. The handle comprises a first fastener 508 and a second fastener 510, the second fastener comprising a support 512. The blade comprises an "L-shaped" bar 514 having a grip 516 (acting as a gripping portion). The bar 514 has first and second end portions 518, 520 where it extends from the blade and a connecting portion 522 in between. The bar has a bend 526 which is closer to the handle than the straight line between the first and second end portions. The first end portion is further from the handle than the second end portion and the second end portion is on the side of the handle towards which the blade moves from its operating position 528 (FIG. 9*a*) to a stowed position 530 (FIG. 9*b*) discussed below. The bar is spaced apart from the paddle due to the end portions extending from the paddle.

The blade is operable to move between an operating position 528 where the blade extends away from the handle, and a stowed position 530 where the blade runs adjacent to the handle, by rotating about the hinged joint. The hinged joint allows movement of the blade in the plane of the blade but does not allow movement perpendicular to that plane such that the blade is locked in that plane. The shaped of the handle means that when a user removes their hand from the grip, the blade can pivot from the operating position to the stowed position. The paddle further comprises an elasticated rope 532 (acting as a biasing element) extending between the handle and the blade across the hinged joint such that the elasticated rope biases the blade towards the stowed position.

During use, the paddle is secured to a forearm of the user using the first fastener and the second fastener, such that first fastener is adjacent the wrist of the user, the second fastener is located on the mid-forearm of the user, and the handle is adjacent to the hand of the user and the user grips the grip of each blade to retain the blade in the operating position. The user may then drive the blades through the water to more effectively propel a board such as a surf board. As the hinged joint is locked in the direction of applied force, the wrists of the user are also locked and therefore the user is able to apply greater leverage to the paddle blade as the blade is driven through the water.

Once the user arrives at their destination, or is ready to move into a standing position to ride a wave, for example, the user releases the grips, thereby allowing the blades to move from the operating position to the stowed position. Accordingly, the user is free to use their hands when standing without risking losing their paddles, or of the blades of the paddles obstructing the hands of the user.

If the user wishes to use the paddles again, the blades may be readily moved by the user from the stowed position back to the operating position and the grips again held by the user.

Figure 15:
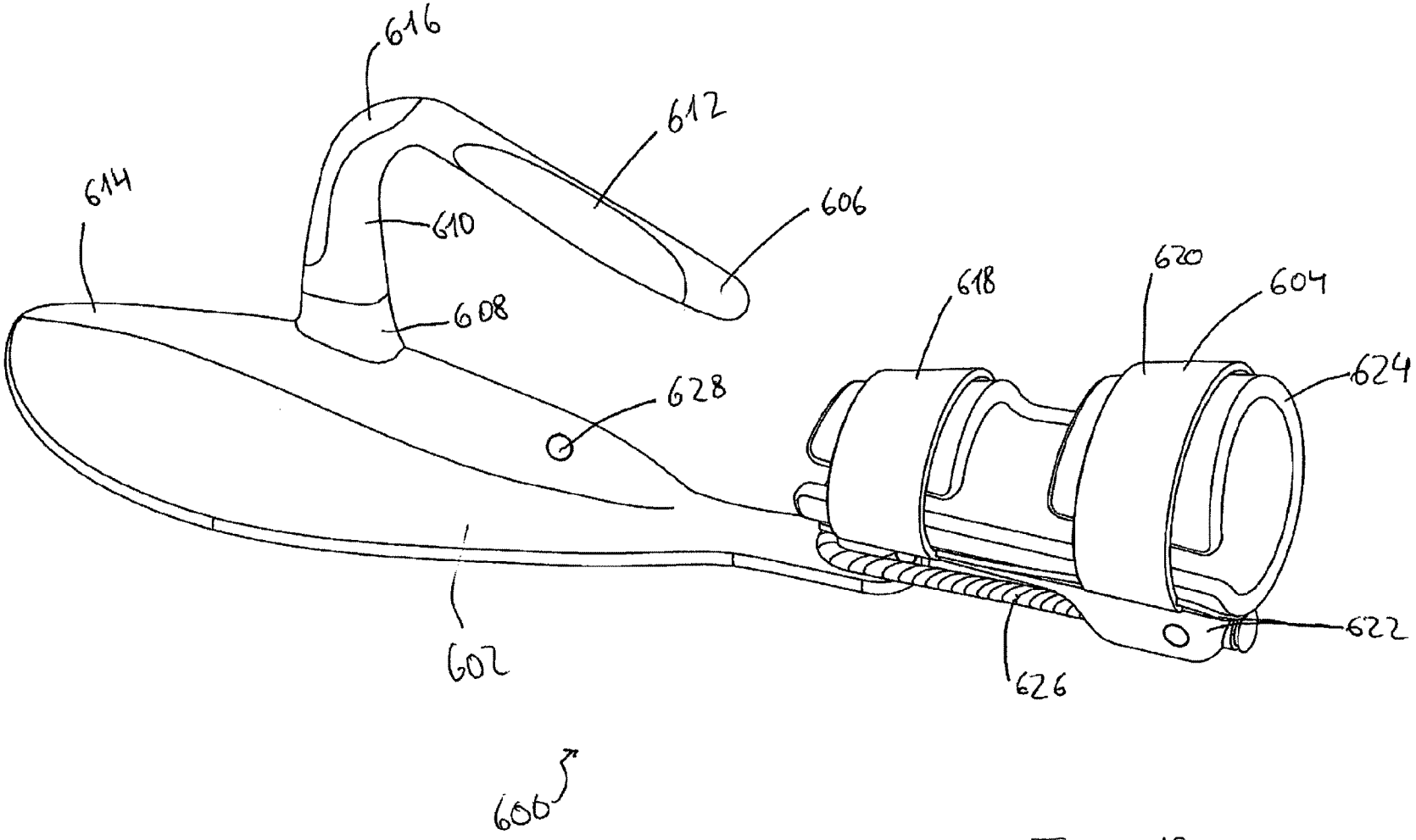
FIG. 15 is a front perspective view of an alternative embodiment of the present invention, in the operating or deployed position.

Referring now to FIG. 15 an alternative embodiment of the present invention will be described. FIG. 15 represents a paddle 600. The paddle comprises a blade 602, a fastener 604 and a gripping portion 606.

The blade 602 is made of plastic and comprises a curved surface. The gripping portion 604 is integral to the blade 602 and comprises a reinforced section 608. The reinforced section 608 of the gripping portion 604 has a larger cross-sectional area than the rest of the gripping portion 604.

The gripping portion 604 is a bar that comprises an end portion 610 which extends outwards form the surface of the blade 602 and a connecting portion 612 which, in use, extends parallely to the blade towards the user's hand. The end portion 610 of the bar in this embodiment is located nearest to the blade end 614 furthest away from the user's hand so that the blade 602 can be retracted 180 degrees from the operating position into a stowed position, as will be described in due course.

The gripping portion 604 comprises a surface section 616 of elevated friction coefficient to facilitate deployment of the paddle 600 from the stowed position to the operating position, such that the user can lean his arms with the stowed paddles 600 onto a static surface (not shown), making the high friction areas 616 of the bars 604 the contact points between the paddle 600 and the static surface. The user then moves his arms backwards, so that the high friction between the bars and the surface pivots the blades 602 into the operating position. This is especially convenient for a surfer which might which to deploy the paddles 600 by using the surfboard as a surface against which to deploy the blades. The high friction area 616 comprises a rubber surface The fastener 604 comprises two spaced apart straps 618, 620 which are attached to a metal plate 622. The fastener 604 also comprises a padded element 624 that protects the forearm from the rigid straps 618, 620 and the metal plate 622. The padded element 624 is a water resistant material, such as neoprene.

The paddle 600 also comprises a biasing element 626. The biasing element 626 is an elasticated rope. The biasing element 626 extends from the fastener 604 to the blade 602 and keeps the paddle 600 folded or in a stowed position in the absence of any force being applied to it.

The blade 602 comprises a magnet 628 that helps to immobilise the blade 602 in the stowed position when the paddle 600 is not used for paddling. This is achieved by the force created between the magnet 628 and the metal plate 622 when the paddle 600 is in the stowed position, the force assisting the biasing element 626 in retaining the blade 602 in the stowed position.

Figure 16:
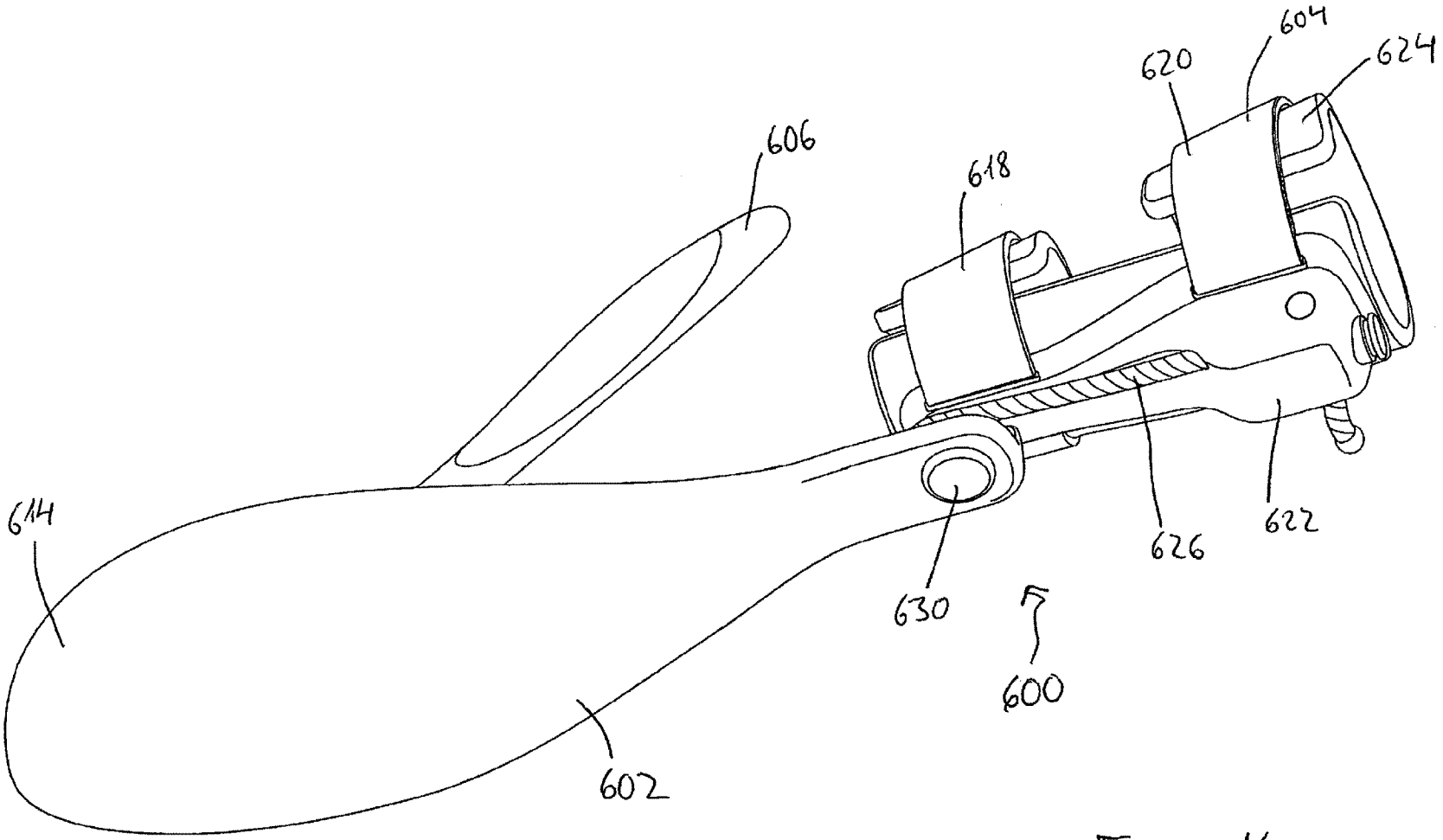
FIG. 16 is a back perspective view of the embodiment shown in FIG. 15, in the operating or deployed position.

In FIG. 16, the back side of the paddle 600 shown in FIG. 15 is depicted. Same numerals are used for the same features. In this view the connector 630 that enables relative movement between the blade 602 and the fastener 604 can be seen. The connector 630 is a pin connector in the form of a metallic bolt and in use, the connector is located behind the user's wrist.

Figure 17:
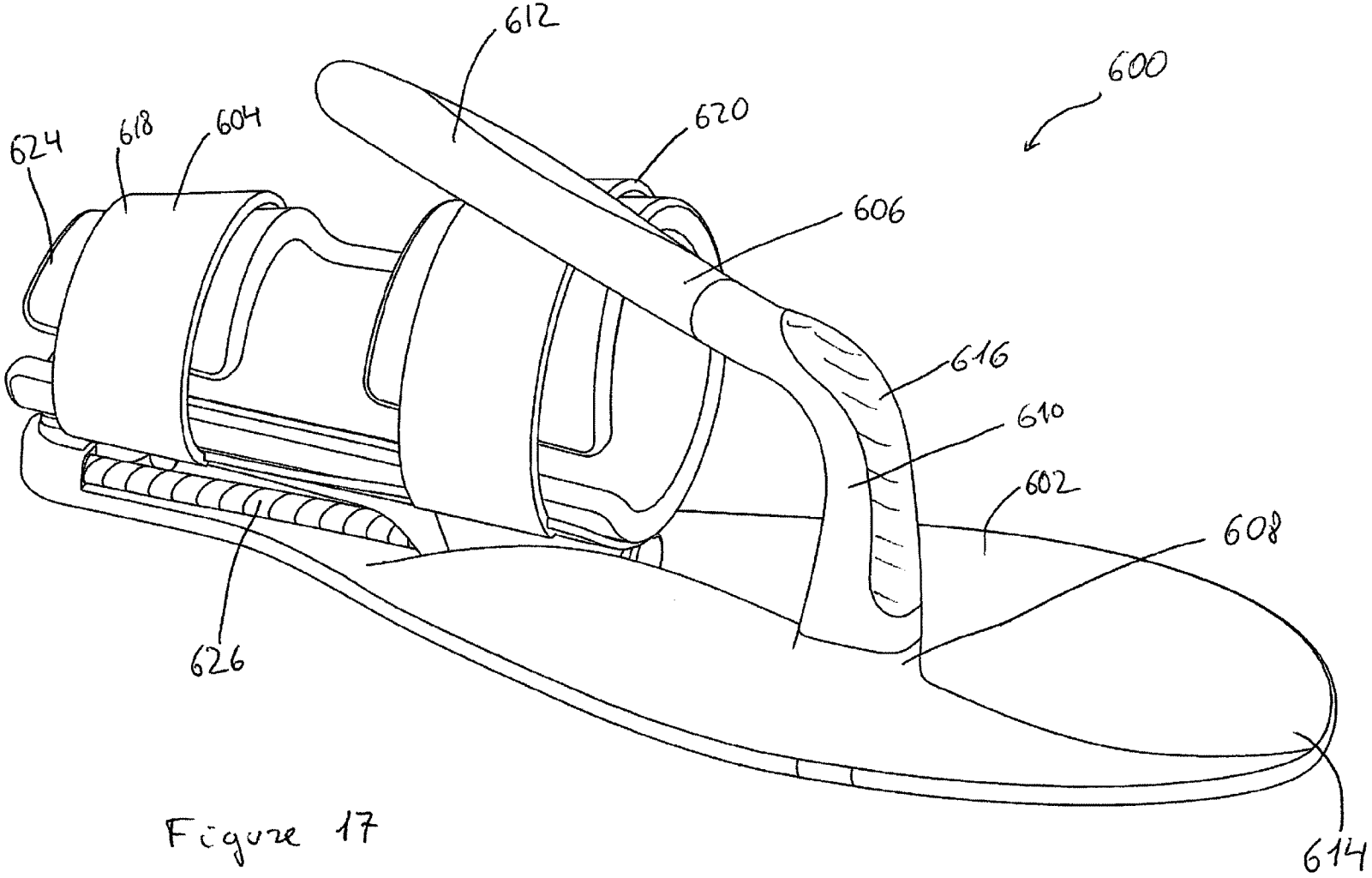
FIG. 17 is a front perspective view of the embodiment shown in FIG. 15, in a stowed position.

In FIG. 17, the paddle 600 shown in FIG. 15 is depicted in the stowed position. The same numerals are used for same features. In this view, the curvature of the blade 602 can be appreciated as well as the precise orientation and shape of the gripping portion 606.

Figure 18:
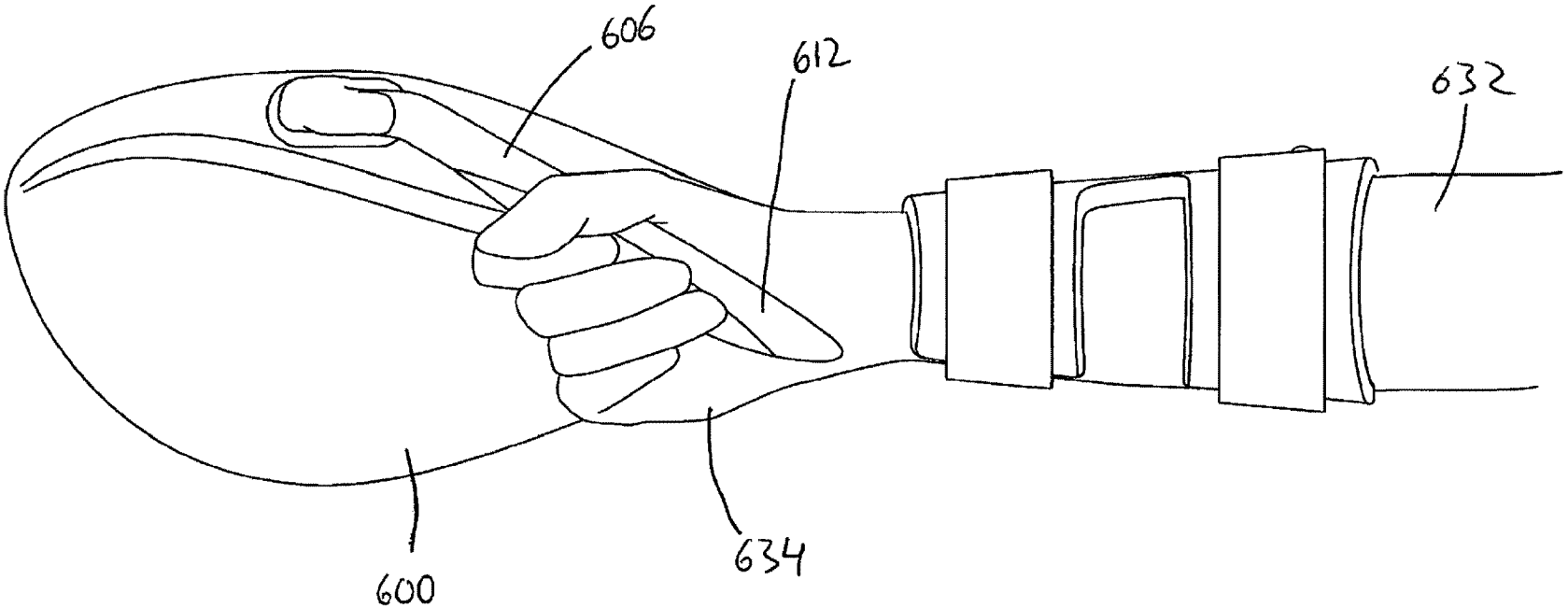
FIG. 18 is a view of the embodiment shown in FIG. 15 as worn by a user in the operating or deployed position.

In FIG. 18 the paddle 600 of FIG. 15 is depicted as worn by a user 632 in an operating position. It can be seen how the user 632 grips the gripping portion 606 by the connecting portion 612. The hand 634, in use, is half way between the prone and the supine position.

Figure 19:
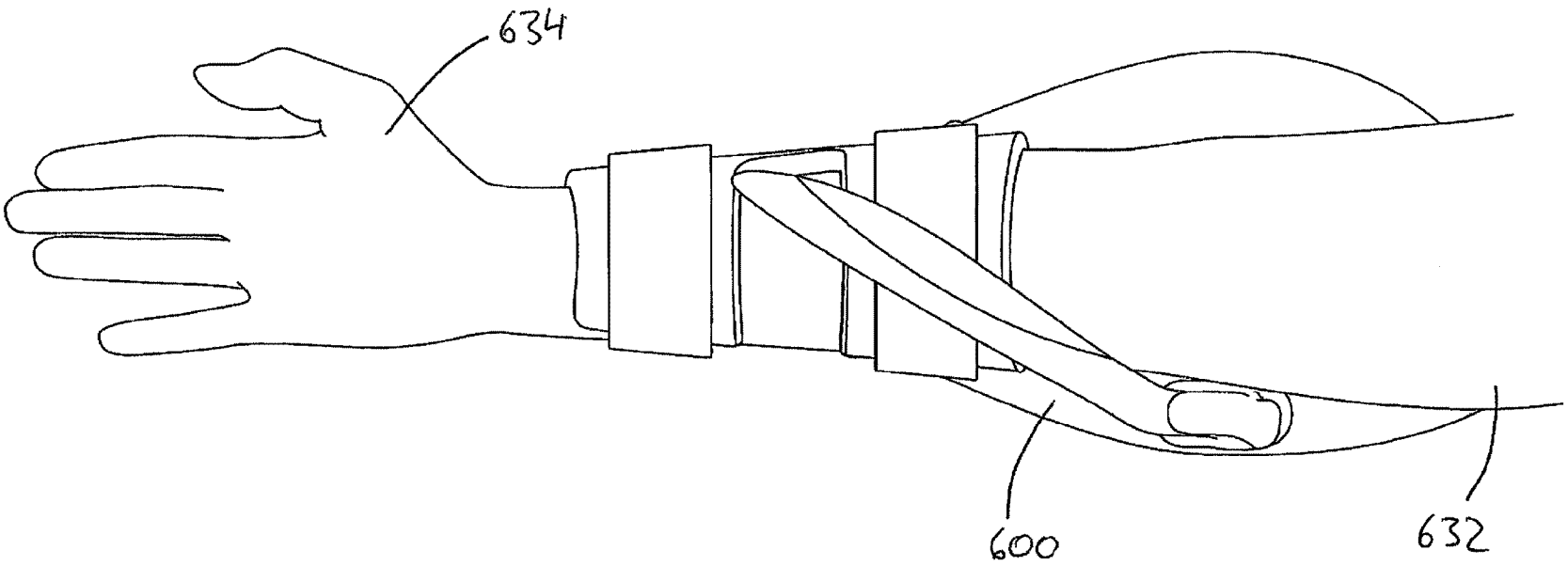
FIG. 19 is a view of the embodiment shown in FIG. 15 as worn by a user in the stowed position.

FIG. 19 shows the paddle 600 of FIG. 15 as worn by a user 632 in a stowed position. It can be seen how the user's hand 634 remains free for carrying out other activities when there is no need to paddle, such as for suddenly pushing up a user's body to stand on a surfboard. The present invention is especially suitable for this situation, because the transition from the operating position to the stowed position takes place almost instantaneously, as the moment of stop paddling and standing on a surfboard requires.

Further variations and modifications may be made within the scope of the invention herein disclosed. For example, the blade may comprise a flexible portion at an outer edge to act like a flipper. In other embodiments, the blade may be scalloped to give greater purchase to the user as they propel themselves forward through the water.

The invention claimed is:

1. A paddle comprising:

a blade, wherein the blade is movable between an operating position and a stowed position;

an arm strap operable to attach the paddle directly to a user's forearm;

a gripping portion mounted to the blade wherein, in use, the user grips the gripping portion to retain the blade in the operating position;

a connector extending from the arm strap to the blade, wherein the connector enables the blade to move with respect to the arm strap between an operating position and a stowed position; and a biasing element extending between the arm strap and the blade, wherein the biasing element is operable to bias the blade to the stowed position and wherein the biasing element is operable to move the blade to the stowed position from the operating position upon releasing the gripping portion.

2. A paddle according to claim 1 wherein the connector is adapted to cause a lateral movement of the blade.

3. A paddle according to claim 1 wherein the connector is located behind the wrist, in use.

4. A paddle according to claim 1 wherein the connector is a pivotal connector operable to permit the to pivot between the operating position and the stowed position in a plane parallel to a surface of the blade.

5. A paddle according to claim 1 wherein the connector comprises a pin about which the blade is pivotally hinged to allow a lateral movement of the blade relative to the wrist, in use.

6. A paddle according to claim 1 wherein the biasing element is a resilient member.

7. A paddle according to claim 1 comprising a first retaining element to temporarily or partially retain or fix the blade in the stowed position.

8. A paddle according to claim 1 comprising a retaining element to temporarily or partially retain or fix the blade in the operating position.

9. A paddle according to claim 1 wherein the gripping portion is movable with respect to the blade.

10. A paddle according to claim 9 wherein the gripping portion is movable with respect to the blade by rotation around an axis perpendicular to the blade.

11. A paddle according to claim 9 wherein the gripping portion is adapted to move in a plane parallel to a surface of the blade.

12. A paddle according to claim 1 comprising a bar comprising first and second end portions which extend outwards from the surface of the blade and a connecting portion which extends between the end portions, spaced apart from the surface of the blade, wherein at least part of the connecting portion functions as the gripping portion.

13. A paddle according to claim 1 comprising a bar comprising a single end member which extends outwards from a surface of the blade and a connecting portion which, in use, is connected to the end portion and wherein the connecting portion extends parallel to the surface of the blade towards the user's hand, wherein at least part of the connecting portion functions as the gripping portion.

14. A paddle according to claim 12 wherein the connecting portion is curved or angled.

15. A paddle according to claim 12 wherein the connecting portion defines a recess within which the blade is at least partially received while the blade is in the stowed position.

16. A method of deploying a paddle attached to a user's arm from a stowed position to a deployed position, the paddle comprising a blade and an arm strap, a biasing element extending between the arm strap and the blade, the blade being movable between an operating position and a stowed position, the paddle being attached to the user's arm by the arm strap, and the blade being movable with respect to the arm strap, the method comprising the steps of:

directly attaching the paddle to a user's forearm by the arm strap;

the user selectively gripping a gripping portion mounted to the blade to retain the blade in the operating position;

engaging a portion of a paddle with a surface, and moving the arm to create relative movement between the arm strap and the blade such that the blade moves to the deployed position;

selectively biasing the blade to the stowed position with the biasing element; and selectively moving the blade to the stowed position from the operating position, via the biasing element, when the user releases the gripping portion.

17. A paddle according to claim 1 wherein the biasing element extends across the connector.

18. A paddle according to claim 13 wherein the single end member defines a space between the connecting portion and the surface of the blade, wherein the blade is at least partially received in the space when the blade is in the stowed position.

* * * * *